US005937600A

United States Patent [19]

Larson

[11] Patent Number: 5,937,600

[45] Date of Patent: Aug. 17, 1999

[54] EXTERIOR WALL SYSTEM AND DRIP CHANNEL

[75] Inventor: John A. Larson, Parkland, Fla.

[73] Assignee: Plastic Components, Inc., Miami, Fla.

[21] Appl. No.: 08/807,655

[22] Filed: Feb. 27, 1997

[51] Int. Cl.[6] ..... E04B 1/70

[52] U.S. Cl. ..... 52/302.6; 52/62

[58] Field of Search ..... 52/58, 62, 302.1, 52/302.3, 302.6, 204.52, 209, 235

[56] References Cited

U.S. PATENT DOCUMENTS 5,289,664 3/1994 Rizza et al. ..... 52/302.1

5,323,577 6/1994 Whitmyer ..... 52/209

5,519,969 5/1996 Golba ..... 52/58

*Primary Examiner*—Michael Safavi

[57] ABSTRACT

A drip channel for use in the construction of exterior wall systems and an exterior wall system using the drip channel are provided. Attached to the wall of a structure is a first vertical panel having a top edge and a bottom edge. A base portion is attached to and extends from the bottom edge of the first vertical panel such that the base portion and the first vertical panel form an oblique angle with one another. The base portion has an outboard edge with a plurality of holes distributed therealong. A second vertical panel is attached to and extends upward from the outboard edge of the base portion.

25 Claims, 5 Drawing Sheets

EXTERIOR WALL SYSTEM AND DRIP CHANNEL

FIELD OF THE INVENTION

The invention relates generally to the construction of synthetic exterior walls systems, and more particularly to a drip channel for use with such exterior wall systems.

BACKGROUND OF THE INVENTION

A variety of exterior wall systems are used in the construction industry. For example, an exterior insulation and finish system (EIFS) is one such exterior wall system. A typical EIFS construction is shown in cross-section in FIG. 1 where a portion of a structure's framing and foundation are shown with the EIFS built thereon. More specifically, in terms of residential construction, foundation 10 is typically a cinderblock or cement foundation having a wood sill plate 12 bolted thereon with wood (or metal) framing studs 14 attached to and extending up from sill plate 12. The conventional EIFS wall system starts with sheathing 16 (e.g., plywood, oriented strand board, cement board, gypsum board, etc.) attached to studs 14 and wrapped with a building wrap material 18 (e.g., felt or other vapor barrier type of building wrap) that is impervious to moisture and wind. Insulating sheathing 20 (e.g., expanded polystyrene or other synthetic insulating boards) are then bonded or glued directly to building wrap material 18 and one or more coats of a (synthetic stucco) finish 22 are applied onto insulating sheathing 20.

While finish 22 is generally designed to be impervious to water, terminations in the wall system around windows and doors have traditionally been the source of moisture entry. The use of building wrap material 18 is generally required by code to prevent moisture from passing therethrough into the structure. However, with nowhere to go, the moisture eventually migrates behind building wrap material 18 into sheathing 16 and even studs 14. Then, building wrap material 18 tends to trap the leaked-in moisture thereby causing moisture damage that can only be repaired by the costly repair/replacement of the EIFS system and, possibly, framing studs 14. Numerous other exterior wall systems such as direct exterior finish systems (DEFS) can also suffer from trapped moisture problems.

One approach to solving this problem involves the use of a lath or other water management system (not shown) interposed between building wrap material 18 and insulating sheathing 20. However, none of the prior art solve the problem of what to do with the moisture if or once it reaches the lower portion of the EIFS.

SUMMARY OF THE INVENTION

Accordingly, it is an object of the present invention to provide an apparatus for use in conjunction with exterior wall systems to help eliminate moisture damage problems associated therewith.

Another object of the present invention is to provide an apparatus that improves the overall quality and appearance of an exterior wall system installation.

Still another object of the present invention is to provide an exterior wall system construction that is easy to install, provides for a quality finish and is essentially eliminates the chance of moisture damage to a structure.

Other objects and advantages of the present invention will become more obvious hereinafter in the specification and drawings.

In accordance with the present invention, a drip channel is provided for exterior wall systems. A first vertical panel has a top edge and a bottom edge. A base portion is attached to and extends from the bottom edge of the first vertical panel such that the base portion and the first vertical panel form an oblique angle with one another. The base portion has an outboard edge with a plurality of holes distributed therealong. A second vertical panel is attached to and extends upward from the outboard edge of the base portion. The first vertical panel is attached to a structure's wall.

In terms of using the drip channel with an exterior wall system, a moisture impervious material covers the exterior-facing surfaces of the structure's wall and covers a portion of the first vertical panel. A sheathing covers the water impervious material. The bottom portion of the sheathing resides between the first and second vertical panels above the base portion. Interposed between the moisture impervious material and the sheathing is a water management system that allows water to drip down therebetween. A finish material is applied to the sheathing and covers the second vertical panel.

BRIEF DESCRIPTION OF THE DRAWINGS

Other objects, features and advantages of the present invention will become apparent upon reference to the following description of the preferred embodiments and to the drawings, wherein corresponding reference characters indicate corresponding parts throughout the several views of the drawings and wherein.

DETAILED DESCRIPTION OF THE INVENTION

Figure 1:
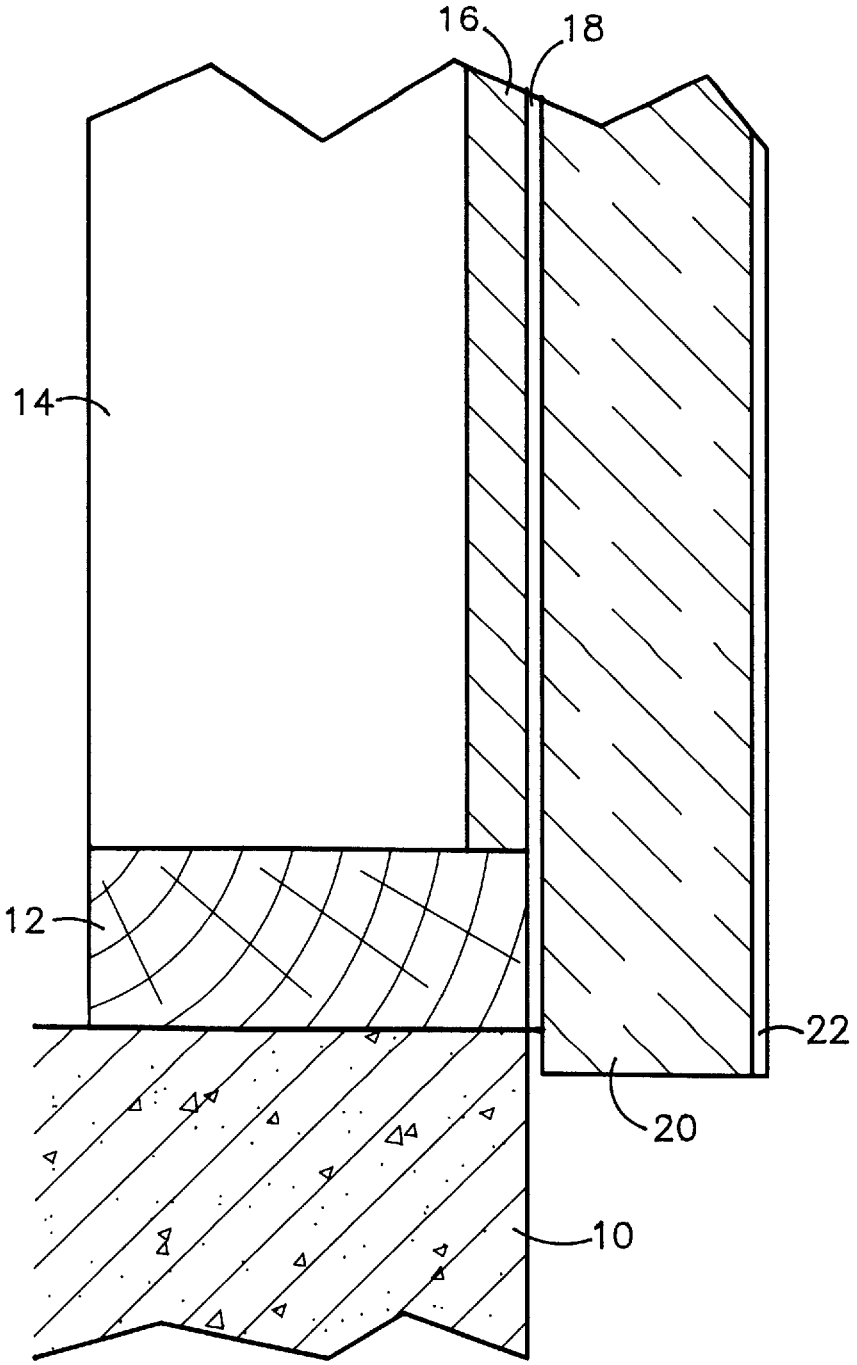
FIG. 1 ( PRIOR ART )
FIG. 1 is a side view of a conventional EIFS installed on a structure that includes a foundation with framing built thereon.
Figure 2:
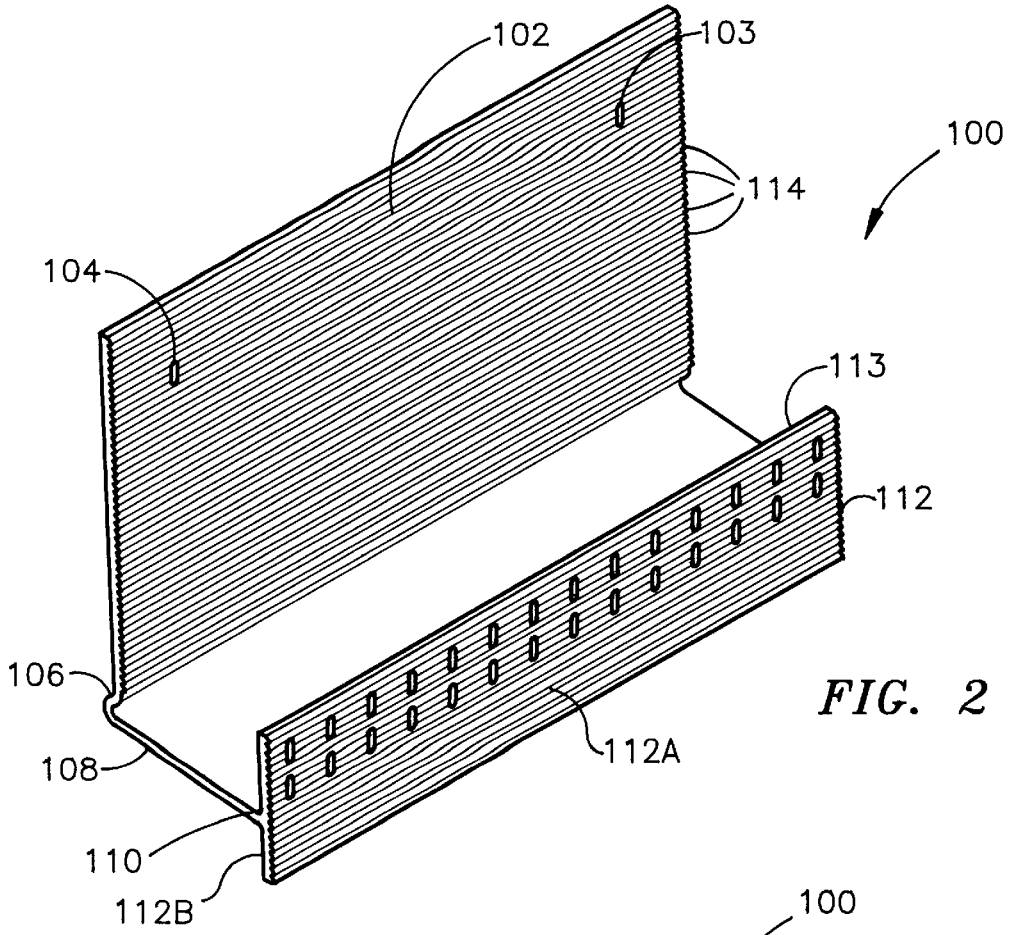
FIG. 2 is a perspective view of the drip channel according to the present invention for use with an EIFS.
Figure 3:
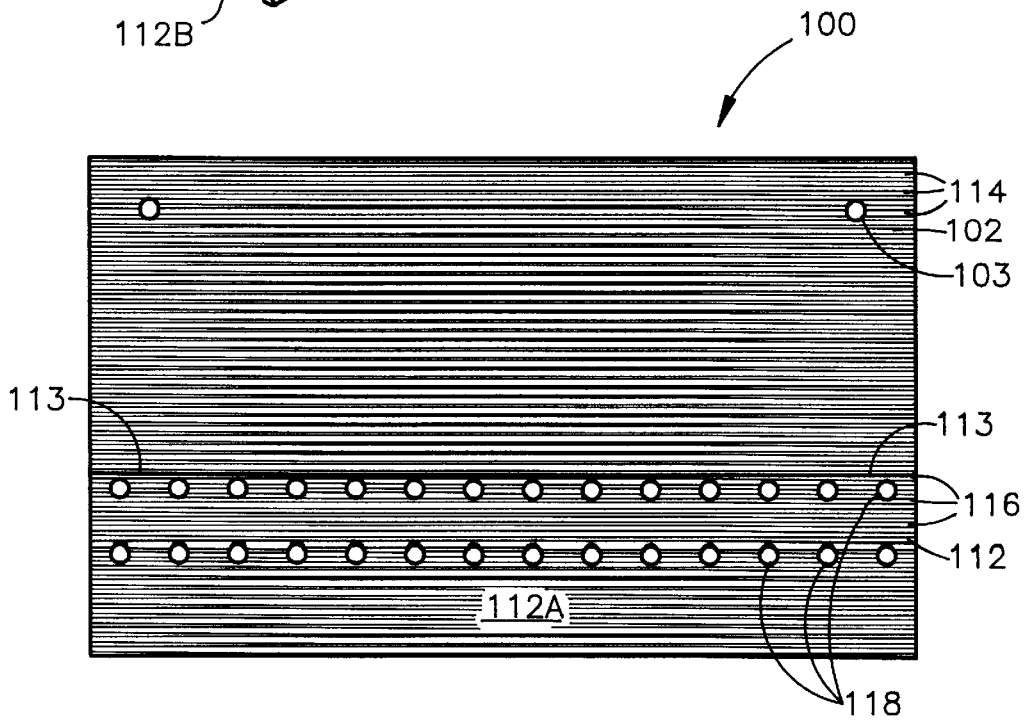
FIG. 3 is a front elevation view of the drip channel.
Figure 4:
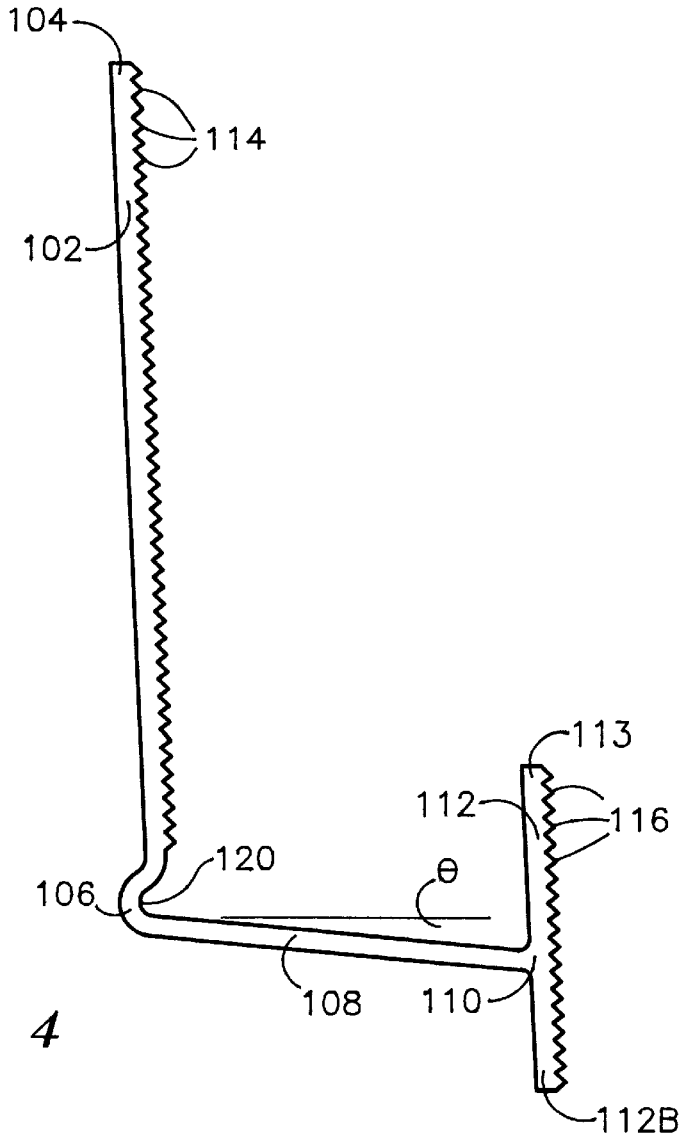
FIG. 4 is a side view of the drip channel.
Figure 5:
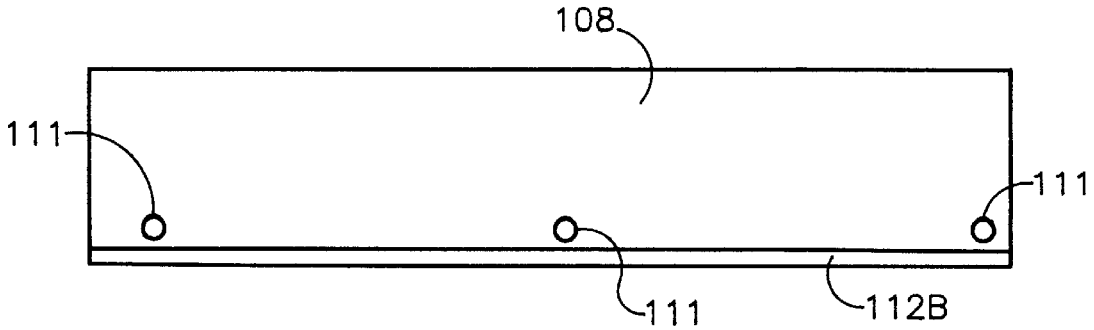
FIG. 5 is a bottom view of the drip channel.
Figure 6:
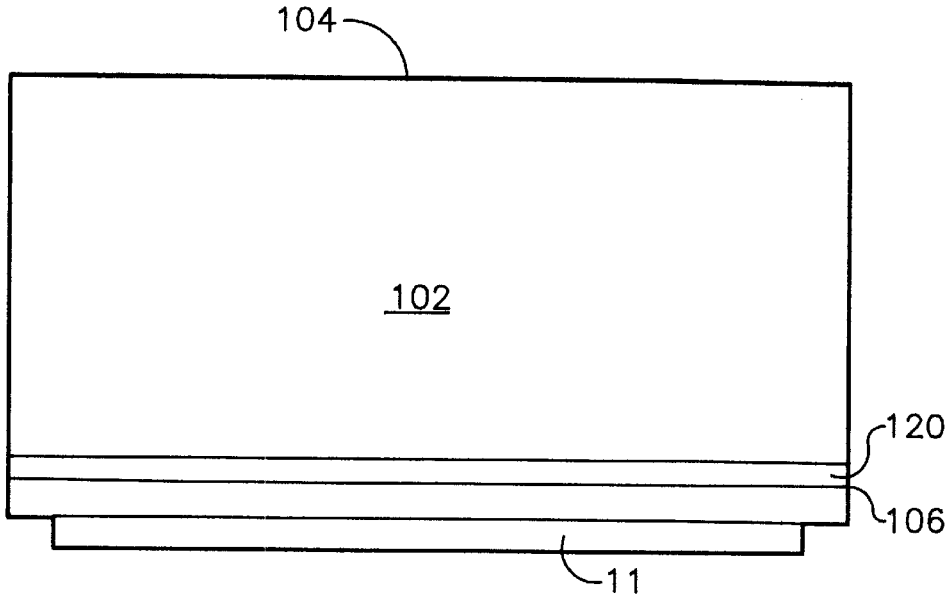
FIG. 6 is a rear elevation view of the drip channel.
Figure 7:
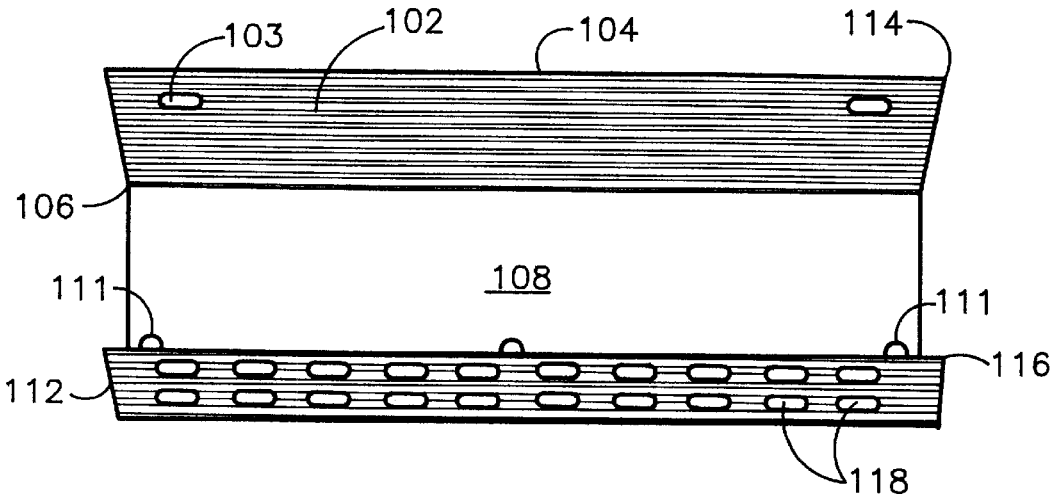
FIG. 7 is a top view of the drip channel.

Referring now to the drawings, and more particularly to FIGS. 2–7, a drip channel of the present invention is shown in a variety of views and is referenced generally by numeral 100. All views will be referred to simultaneously since some features are obscured or are unclear by referring to only one view. Accordingly, like reference numerals for common elements will be used throughout the various views.

Drip channel 100 includes a first vertical panel 102 having a top edge 104 and a bottom edge 106, a base 108 attached to and extending away from bottom edge 106, and a second vertical panel 112 attached to and extending upward from the outboard edge 110 of base 108. By way of example, drip channel 100 is of integral construction and is typically made from a plastic (e.g., polyvinylchloride or PVC) or sheet metal.

Panel 102 is taller than panel 112 in order to provide a nailing surface for installation thereof as will be explained below. Typically, nail holes 103 are provided in the upper portion of panel 102. Panel 102 and base 108 are arranged to form an oblique angle θ with one another. For example, in the illustrated embodiment, the angle θ is on the order of 95°. However, a variety of other oblique angles could be used without departing from the scope of the present invention. Distributed along outboard edge 110 are a plurality drip holes 111 passing through base 108. Typical spacing between holes 111 is approximately 3 inches on center. Panel 112 can be, but need not be, angled slightly towards panel 102 (e.g., in the illustrated embodiment, panel 102 and panel 112 form an angle of a few degrees with one another). Further, panel 112 can extend below base 108 by at least approximately ¼ inch to form a drip edge portion 112B.

While the above-described features of drip channel 100 deal with the moisture removal problem associated with EIFS or other exterior wall systems, drip channel 100 can also include a variety of features that improve installation procedures as well as the overall quality of an exterior wall system utilizing drip channel 100. For example, one face (i.e., the nailing face) of panel 102 can incorporate horizontal striations or grooves 114, the troughs of which penetrate approximately 20–25% into panel 102. Grooves 114 improve bonding adhesion between panel 102 and any material that is to be bonded thereto with an adhesive. The overall thickness of panel 102 can be such that it maintains its shape even when attached to an undulating foundation and/or sheathing wall. For example, if constructed of PVC, panel 102 has been found to maintain its shape for most applications when it is approximately 85 thousandths of an inch thick. Obviously, other materials or applications can require thicknesses that are greater than or less than this. Panel 102 can also be tapered near top edge 104 to a reduced thickness therealong so as not to present a ledge on which moisture can accumulate as will become apparent in the construction description below.

As mentioned above, panel 112 can be angled slightly towards panel 102. This allows panel 112 to apply a compression force to materials fitted between panel 102 and panel 112. In terms of improving moisture removal, this allows the materials fitted between panel 102 and panel 112 to maintain their proper orientation to one another. Further, drip edge portion 112B allows moisture dripping down the exterior face 112A of panel 112 to drip down therefrom as opposed to attaching to the bottom of base 108 by means of surface tension.

In addition, panel 112 can also incorporate features to improve the installation and overall quality of an EIFS using drip channel 100. For example, exterior face 112A can incorporate horizontal grooves 116 (similar to grooves 114) to improve bonding adhesion of base and finish coats of the wall system as will be explained further below. A plurality of holes 118 can be provided through panel 112 to further facilitate bonding adhesion. Panel 112 can be tapered to a reduced thickness along its upper edge 113. This reduces the chance that upper edge 113 will protrude from the finish coats of the wall system and reduces the possibility that the base and finish coats will crack due to a sudden change in thickness of the base and finish coats at upper edge 113.

Still another construction aid and quality feature that contributes to the overall quality of a wall system using drip channel 100 is an alignment channel 120 formed along bottom edge 106 of panel 102. Alignment channel 120 is, for example, a C-shaped channel designed to receive an alignment pin or clip (not shown). In this way, abutting ends of adjacent drip channels 100 can be aligned by inserting the alignment pin or clip across the interface of adjacent drip channels 100.

Figure 8:
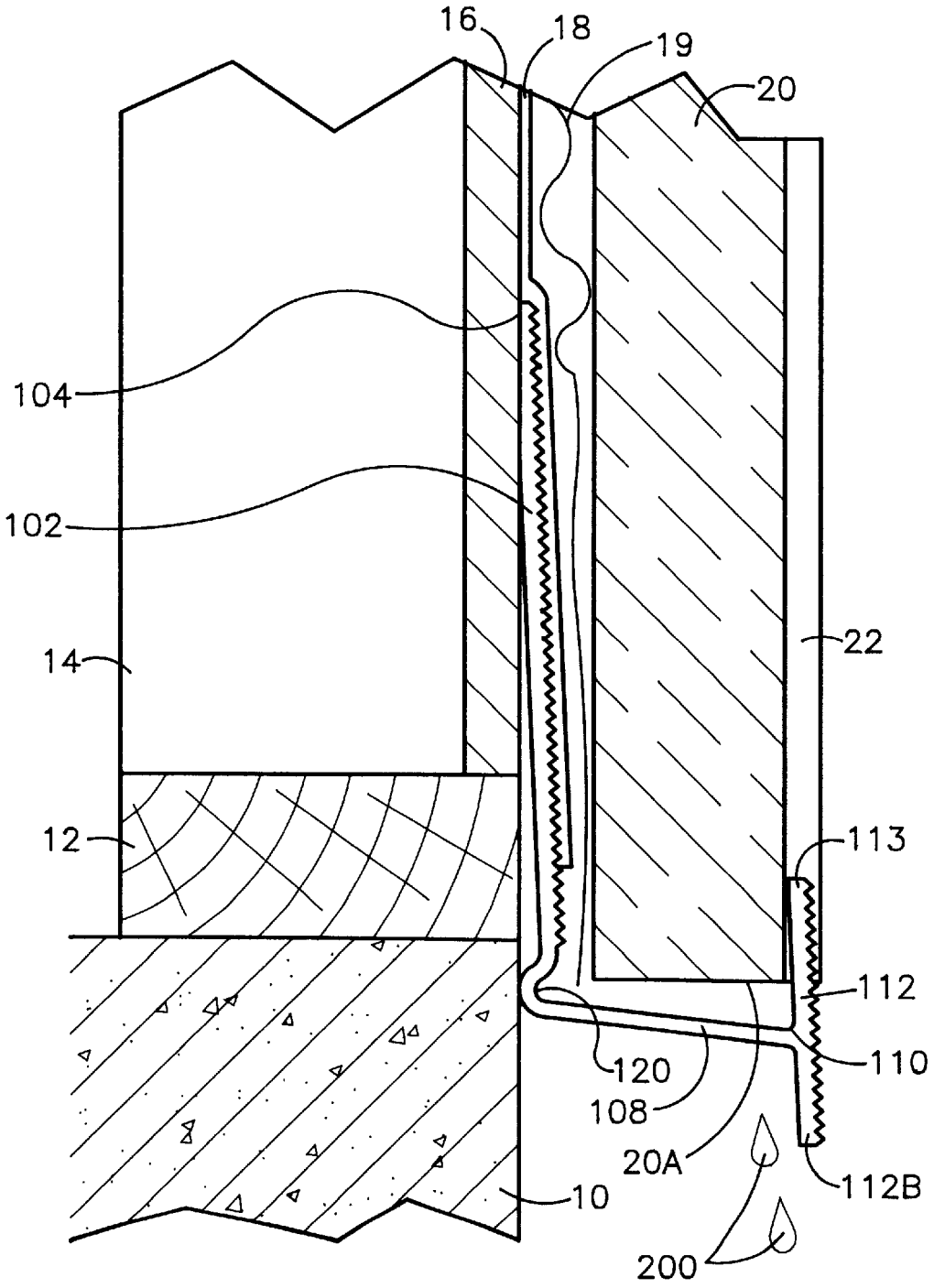
FIG. 8 is a side view of one example of an exterior wall construction using the drip channel in accordance with the present invention.

By way of example, an exterior wall construction utilizing drip channel 100 is shown in FIG. 8. After sheathing 16 is affixed to framing studs 14, drip channel 100 is attached (e.g., nailed) in place to cover the interface between the structure's framing (e.g., sill plate 12) and foundation 10. Sheathing 16 is then covered with building wrap 18. In doing this, building wrap 18 is allowed to overlap a portion of panel 102. A lath 19 (preferably plastic in construction) or other water management system is interposed between building wrap 18 and insulating board 20. Lath 19 extends into drip channel 100 parallel to panel 102. Examples of suitable lath constructions are disclosed in U.S. Pat. Nos. 5,287,673 and 5,481,843. A finish sheathing, e.g., insulating sheathing 20, covers lath 19 and is bonded or glued to lath 19. Note that an alternative to using lath 19 is to provide vertical scores in the face of insulating sheathing 20 adjacent building wrap 18 so that moisture can migrate down sheathing 20 to drip channel 100. In either case, insulating sheathing 20 is fitted between panel 102 and panel 112 and bonded in place such that its lower edge 20A is above base 108.

The gap between panel 102 and upper edge 113 of panel 112 is chosen to be slightly less than the combined thickness of building wrap 18, lath 19 (if used) and insulating sheathing 20 in order to apply pressure to this combination to maintain their proper orientation along the lower edge of the wall system. Base and finish coats (collectively referenced by numeral 22) are then applied to the exterior face of insulating board 20 and face 112A of panel 112.

In terms of moisture removal, the EIFS wall system shown in FIG. 8 operates as follows. If moisture migrates behind insulating sheathing 20, it immediately falls under the force of gravity through the provided water management system, e.g., lath 19, that is interposed between building wrap 18 and insulating sheathing 20. Upon reaching drip channel 100, the moisture travels on base 108 under insulating board 20 to drip holes 111. The oblique angle of base 108 relative to panel 102 facilitates travel of such moisture. Since drip holes 111 are along outboard edge 110, the moisture (represented by drops 200) is carried away from the wall system.

The advantages of the present invention are numerous. The drip channel can be used with EIFS or other exterior wall systems to collect and channel water away from the wall system. The drip channel can also incorporate a variety of additional features that facilitate construction of the EIFS and improve the overall finish quality thereof.

Although the invention has been described relative to a specific embodiment thereof, there are numerous variations and modifications that will be readily apparent to those skilled in the art in light of the above teachings. It is therefore to be understood that, within the scope of the appended claims, the invention may be practiced other than as specifically described.

What is claimed as new and desired to be secured by letters patent of the united states is:

1. A plastic drip channel for exterior wall systems, comprising:

a first vertical panel to provide a nailing surface for attachment to a wall of a structure, said first vertical panel having a top edge and a bottom edge;

a base portion attached to and extending outwardly from said bottom edge of said first vertical panel such that said base portion and said first vertical panel from an oblique angle with one another, said base portion having an outboard edge with a plurality of holes distributed therealong;

a second vertical panel attached to and extending upward from said outboard edge of said base portion with an exterior face; and indentations on said exterior face to improve bonding adhesion.

2. A drip channel as in claim 1 wherein said first vertical panel includes horizontally-oriented grooves on one face thereof facing said second vertical panel.

3. A drip channel as in claim 1 wherein the wall is undulating and wherein said first vertical panel is thick enough to allow said first vertical panel to maintain its shape when attached to the wall.

4. A drip channel as in claim 1 wherein said first vertical panel is tapered to a reduced thickness near said top edge.

5. A drip channel as in claim 1 wherein said second vertical panel is angled towards said first vertical panel.

6. A drip channel as in claim 1 wherein indentations on said second vertical panel includes horizontally-oriented grooves on said exterior face.

7. A drip channel as in claim 1 wherein said second vertical panel includes a plurality of perforations.

8. A drip channel as in claim 1 wherein said second vertical panel has an upper edge, and wherein said second vertical panel is tapered to have a reduced thickness at said upper edge.

9. A drip channel as in claim 1 wherein said second vertical panel extends both upwardly and downwardly past said base portion along said outboard edge thereof.

10. A drip channel as in claim 1 wherein said first vertical panel, said base portion and said second vertical panel are of integral construction.

11. A drip channel as in claim 1 wherein said bottom edge of said first vertical panel forms a C-shaped channel for receiving an alignment device therein whereby adjacent ones of said drip channels can be aligned with one another.

12. A drip channel for exterior walls, comprising:

a first vertical panel for attachment along an exterior wall of a structure, said first vertical panel having a top edge and a bottom edge, said first vertical panel being tapered to a reduced thickness near said top edge, said first vertical panel having outwardly facing horizontally-oriented grooves on one face thereof;

a base portion attached to and extending from said bottom edge of said first vertical panel such that said base portion and said first vertical panel form an oblique angle with one another, said base portion having an outboard edge with a plurality of holes distributed therealong; and a second vertical panel attached to and extending upward from said outboard edge of said base portion to an upper edge of said second vertical panel, said second vertical panel having indentations on one face thereof that faces outwardly.

13. A drip channel as in claim 12 wherein the exterior wall is undulating and wherein said first vertical panel is approximately 85 thousandths of an inch thick to allow said first vertical panel to maintain its shape when attached to the exterior wall.

14. A drip channel as in claim 12 wherein said second vertical panel is tapered to have a reduced thickness at said upper edge.

15. A drip channel as in claim 12 wherein said second vertical panel is angled towards said first vertical panel.

16. A drip channel as in claim 12 wherein said second vertical panel extends both upwardly and downwardly past said base portion along said outboard edge thereof.

17. A drip channel as in claim 12 wherein said first vertical panel, said base portion and said second vertical panel are of integral construction.

18. A drip channel as in claim 12 wherein said bottom edge of said first vertical panel forms a C-shaped channel for receiving an alignment device therein whereby adjacent ones of said drip channels can be aligned with one another.

19. An exterior wall system for a structure comprising:

a first vertical panel attached to a wall of the structure, said first vertical panel having a top edge and a bottom edge, said first vertical panel being tapered to a reduced thickness near said top edge, said first vertical panel having horizontally-oriented grooves on one face thereof facing away from the wall;

a base portion attached to and extending from said bottom edge of said first vertical panel such that said base portion and said first vertical panel form an oblique angle with one another, said base portion having an outboard edge with a plurality of holes distributed therealong;

a second vertical panel attached to and extending upward from said outboard edge of said base portion to an upper edge of said second vertical panel, said second vertical panel having horizontally-oriented grooves on one face thereof facing away from the wall, said second vertical panel further having a plurality of perforations passing therethrough;

a moisture impervious material covering exterior-facing surfaces of the wall above said base portion and covering at least a portion of said first vertical panel;

a sheathing covering said moisture impervious material wherein a bottom portion of said sheathing resides between said first vertical panel and said second vertical panel above said base portion;

a water management system interposed between said moisture impervious material and said sheathing for allowing moisture to migrate therebetween towards said bottom portion of said sheathing; and a finish material applied to said sheathing and covering said second vertical panel.

20. An exterior wall system as in claim 19 wherein said wall is undulating and wherein said first vertical panel is thick enough to allow said first vertical panel to maintain its shape when attached to said wall.

21. An exterior wall system as in claim 19 wherein said second vertical panel is tapered to have a reduced thickness at said upper edge.

22. An exterior wall system as in claim 19 wherein said second vertical panel is angled towards said first vertical panel.

23. An exterior wall system as in claim 19 wherein said second vertical panel extends both upwardly and downwardly past said base portion along said outboard edge thereof.

24. An exterior wall system as in claim 19 wherein said first vertical panel, said base portion and said second vertical panel are of integral construction.

25. An exterior wall system as in claim 19 wherein said bottom edge of said first vertical panel forms a C-shaped channel for receiving an alignment device therein whereby adjacent ones of said first vertical panels can be aligned with one another.

* * * * *